US009839253B2

(12) United States Patent
Bruce et al.

(10) Patent No.: US 9,839,253 B2
(45) Date of Patent: Dec. 12, 2017

(54) LAST SYSTEM FOR BRAIDING FOOTWEAR

(71) Applicant: NIKE, Inc., Beaverton, OR (US)

(72) Inventors: Robert M. Bruce, Portland, OR (US); Eun Kyung Lee, Beaverton, OR (US); Craig K. Sills, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 288 days.

(21) Appl. No.: 14/565,682

(22) Filed: Dec. 10, 2014

(65) Prior Publication Data

US 2016/0166000 A1 Jun. 16, 2016

(51) Int. Cl.

| | |
|---|---|
| ***A43B 1/04*** | (2006.01) |
| ***A43D 3/02*** | (2006.01) |
| ***D04C 1/06*** | (2006.01) |
| ***D04C 3/48*** | (2006.01) |
| ***A43B 23/02*** | (2006.01) |

(52) U.S. Cl.

CPC ..... *A43B 1/04* (2013.01); *A43B 23/0225* (2013.01); *A43B 23/0245* (2013.01); *A43B 23/0265* (2013.01); *A43D 3/02* (2013.01); *A43D 3/022* (2013.01); *D04C 1/06* (2013.01); *D04C 3/48* (2013.01); *D10B 2501/043* (2013.01)

(58) Field of Classification Search

CPC ..... A43B 1/04; D04C 3/48
USPC ..... D2/979
See application file for complete search history.

(56) References Cited

U.S. PATENT DOCUMENTS

| | | | |
|---|---|---|---|
| 165,941 | A | 7/1875 | Malhebe |
| 293,020 | A | 2/1884 | Hedtmann et al. |
| 329,739 | A | 11/1885 | Heostkels |
| 376,372 | A | 1/1888 | Dodge et al. |
| 810,056 | A | 1/1906 | Janssen et al. |
| 847,005 | A | 3/1907 | Kirberg et al. |
| 894,022 | A | 7/1908 | Lepperhof et al. |
| 920,994 | A | 5/1909 | Prante et al. |
| 936,356 | A | 10/1909 | Rahm et al. |
| 979,502 | A | 12/1910 | Janssen et al. |
| 1,117,330 | A | 11/1914 | Cobb |

(Continued)

FOREIGN PATENT DOCUMENTS

| | | | |
|---|---|---|---|
| DE | 726634 | C | 10/1942 |
| DE | 4306286 | A1 | 9/1993 |

(Continued)

OTHER PUBLICATIONS

International Search Report and Written Opinion mailed Jan. 19, 2016 in PCT Application No. PCT/US2015/055625.

(Continued)

*Primary Examiner* — Shaun R Hurley

(74) *Attorney, Agent, or Firm* — Shook, Hardy and Bacon LLP

(57) ABSTRACT

An article of footwear can include a braided upper. The structure of the braided upper may be manufactured using an article forming member and a braiding apparatus. The article forming member includes a body portion substantially similar to a last for shoemaking, as well as a flange portion that extends outward from the body portion. The article forming member moves through the braiding apparatus in varying orientations that can improve the efficiency of the braiding, enhance the braiding pattern, and enhance structural support of the braided upper.

19 Claims, 10 Drawing Sheets

(56) References Cited

U.S. PATENT DOCUMENTS 1,318,888 A 10/1919 Le Carpentier
1,379,478 A * 5/1921 Schevitz ..... A43D 3/08 12/114.6
1,527,344 A 2/1925 Bente et al.
1,538,160 A 5/1925 Bosebeck et al.
1,554,325 A 9/1925 Bente et al.
1,583,273 A 5/1926 Bosebeck et al.
1,593,670 A 7/1926 Petersen et al.
1,622,021 A 3/1927 Birkin et al.
1,637,716 A 8/1927 Turck et al.
1,887,643 A 11/1932 Huber et al.
2,022,350 A 11/1935 Huber et al.
2,091,215 A 8/1937 Price et al.
2,188,640 A 1/1940 Bloch et al.
2,334,399 A 11/1943 Fether et al.
2,788,700 A 4/1957 Crossley et al.
2,936,670 A 5/1960 Walter et al.
2,941,440 A 6/1960 Scanlon
2,960,905 A 11/1960 Scanlon et al.
3,282,757 A 11/1966 Brussee
3,397,847 A 8/1968 Thaden
3,426,804 A 2/1969 Bluck
3,521,315 A * 7/1970 Chatzimikes ..... A43D 3/027 12/136 R
3,541,247 A 11/1970 Moi et al.
3,586,058 A 6/1971 Ahrens et al.
3,714,862 A 2/1973 Berger
4,005,873 A 2/1977 Jacobsen et al.
4,275,638 A 6/1981 DeYoung
4,312,261 A 1/1982 Florentine
4,323,925 A 4/1982 Abell et al.
4,351,889 A 9/1982 Sundberg et al.
4,366,476 A 12/1982 Hickin
4,494,436 A 1/1985 Kruesi
4,519,290 A 5/1985 Inman et al.
4,591,155 A 5/1986 Adachi
4,615,256 A 10/1986 Fukuta et al.
4,719,837 A 1/1988 McConnell et al.
4,847,063 A 7/1989 Smith
4,848,745 A 7/1989 Bohannan et al.
4,857,124 A 8/1989 Shobert et al.
4,884,309 A * 12/1989 Shafir ..... A43D 1/04 12/1 R
4,885,973 A 12/1989 Spain
4,916,997 A 4/1990 Spain
4,976,812 A 12/1990 McConnell et al.
4,992,313 A 2/1991 Shobert et al.
5,001,961 A 3/1991 Spain
5,067,525 A 11/1991 Tsuzuki et al.
5,121,329 A 6/1992 Crump et al.
5,203,249 A * 4/1993 Adams ..... D04C 3/48 87/34
5,257,571 A 11/1993 Richardson et al.
5,287,790 A 2/1994 Akiyama et al.
5,348,056 A 9/1994 Tsuzuki
5,361,674 A 11/1994 Akiyama et al.
5,388,497 A * 2/1995 Akiyama ..... D04C 1/06 87/34
5,396,829 A 3/1995 Akiyama et al.
5,398,586 A 3/1995 Akiyama et al.
5,439,215 A 8/1995 Ratchford
5,476,027 A * 12/1995 Uchida ..... D04C 1/06 87/29
5,601,522 A 2/1997 Piramoon et al.
5,879,725 A 3/1999 Potter
5,885,622 A * 3/1999 Daley ..... A43B 7/02 12/129.4
5,915,030 A 6/1999 Viebach
6,024,005 A * 2/2000 Uozumi ..... D04C 3/34 87/29
6,029,375 A 2/2000 Borel
6,345,598 B1 2/2002 Bogdanovich et al.
6,495,227 B1 12/2002 Cahuzac
6,510,961 B1 1/2003 Head et al.
6,679,152 B1 1/2004 Head et al.
6,696,001 B1 2/2004 Quddus
6,741,728 B1 5/2004 Genest
7,004,967 B2 2/2006 Chouinard et al.
7,079,916 B2 7/2006 Stimpson
7,093,527 B2 8/2006 Rapaport et al.
7,204,903 B2 4/2007 Yasui
7,252,028 B2 8/2007 Bechtold et al.
7,262,353 B2 8/2007 Bartholomew et al.
7,300,014 B2 11/2007 Allen
7,444,916 B2 11/2008 Hirukawa
7,566,376 B2 7/2009 Matsuoka
7,661,170 B2 2/2010 Goode et al.
7,793,576 B2 9/2010 Head et al.
7,815,141 B2 10/2010 Uozumi et al.
7,908,956 B2 3/2011 Dow et al.
7,938,853 B2 5/2011 Chouinard et al.
8,006,601 B2 8/2011 Inazawa et al.
8,061,253 B2 11/2011 Wybrow
8,192,572 B2 6/2012 Willey et al.
8,210,086 B2 7/2012 Head et al.
8,261,648 B1 9/2012 Marchand et al.
8,347,772 B2 1/2013 Dow et al.
8,394,222 B2 3/2013 Rettig
8,511,214 B2 8/2013 Gries
8,578,534 B2 11/2013 Langvin et al.
8,651,007 B2 2/2014 Adams
8,690,962 B2 4/2014 Dignam et al.
8,757,038 B2 6/2014 Siegismund
8,770,081 B2 7/2014 David et al.
8,789,452 B1 7/2014 Janardhan et al.
8,794,118 B2 8/2014 Dow et al.
9,144,284 B2 9/2015 Chung et al.
9,181,642 B2 11/2015 Cahuzac
2001/0026740 A1* 10/2001 Yamanishi ..... B27C 5/00 409/80
2002/0160068 A1* 10/2002 Nakamura ..... B29C 31/002 425/112
2004/0200014 A1* 10/2004 Pons ..... A43D 3/02 12/145
2004/0237760 A1* 12/2004 Shimizu ..... D04C 1/02 87/34
2005/0039769 A1 2/2005 Bousfield et al.
2005/0178026 A1 8/2005 Friton
2008/0189194 A1 8/2008 Bentvelzen
2009/0193961 A1 8/2009 Jensen et al.
2009/0306762 A1 12/2009 McCullagh et al.
2011/0232008 A1 9/2011 Crisp
2013/0239790 A1 9/2013 Thompson et al.
2013/0258085 A1 10/2013 Leedy et al.
2013/0269159 A1 10/2013 Robitaille et al.
2013/0304232 A1 11/2013 Gries
2013/0305465 A1 11/2013 Siegismund
2013/0305911 A1 11/2013 Masson et al.
2014/0088688 A1 3/2014 Lilburn et al.
2014/0182170 A1 7/2014 Wawrousek et al.
2014/0182447 A1 7/2014 Kang et al.
2014/0230634 A1 8/2014 Nakai
2014/0283671 A1 9/2014 Head et al.
2014/0373389 A1 12/2014 Bruce
2014/0377488 A1 12/2014 Jamison
2015/0007451 A1 1/2015 Bruce
2015/0045831 A1 2/2015 Allen
2015/0299916 A1 10/2015 Reinisch
2016/0076178 A1 3/2016 Head et al.
2016/0158769 A1 6/2016 Hornek et al.
2016/0289873 A1 10/2016 Head

FOREIGN PATENT DOCUMENTS

EP 1486601 A1 12/2004
EP 2657384 A1 10/2013
GB 161552 A 12/1921
GB 477556 A 1/1938
GB 1196983 A 7/1970
JP H0995844 A 4/1997
JP 10158965 A 6/1998
JP 2008240187 A 10/2008

(56) References Cited

FOREIGN PATENT DOCUMENTS

| | | | |
|---|---|---|---|
| JP | 2013147760 | A | 8/2013 |
| KR | 20020038168 | A | 5/2002 |
| TW | M305221 | U | 1/2007 |
| TW | M447894 | U | 3/2013 |
| TW | 201328624 | A | 7/2013 |
| TW | M473088 | U | 3/2014 |
| TW | M487651 | U | 10/2014 |
| WO | 0153583 | A1 | 7/2001 |
| WO | 2009000371 | A1 | 12/2008 |
| WO | 2011111564 | A1 | 9/2011 |
| WO | 2012100912 | A1 | 8/2012 |

OTHER PUBLICATIONS

Branscomb D., et al., "New Directions in Braiding," Journal of Engineered Fibers and Fabrics, 2013, vol. 8 (2), pp. 11-24.

Ricardo Bilton: "How 3D body scanning will help you find a suit that actually fits", May 2, 2013 (May 2, 2013), XP055241783, URL:http://venturebeat.com/2013/05/02/how-3d-body-scanning-will-help-you-find-a-suit-that-actually-fits/, Retrieved on Jan. 15, 2016.

Anonymous: "3D print shoe last", styleforum, Feb. 19, 2014 (Feb. 19, 2014), pp. 1-4, XP055241611, Retrieved from the Internet on Jan. 14, 2016: URL:http://www.styleforum.net/t/137783/3dprint-shoe-last.

Non-Final Office Action dated Jun. 1, 2017 in U.S. Appl. No. 14/821,125, 21 pages.

International Preliminary Report on Patentability dated Jun. 22, 2017 in International Patent Application No. PCT/US2015/055625,5 pages.

International Search Report with Written Opinion dated Jan. 27, 2016 in International Patent Application No. PCT/US2015/055884, 14 pages.

International Search Report and Written Opinion dated Sep. 27, 2016 for International Patent Application No. PCT/US2016/034097, 13 pages.

International Search Report and Written Opinion dated Nov. 11, 2016 in International Patent Application No. PCT/US2016/034102, 19 pages.

International Preliminary Report on Patentability dated Jun. 22, 2017 in International Patent Application No. PCT/US2015/055884,4 pages.

International Search Report and Written Opinion dated Nov. 14, 2016 for International Patent Application No. PCT/US2016/034104, 19 pages.

International Search Report and Written Opinion dated Nov. 17, 2016 for International Patent Application No. PCT/US2016/045319, 13 pages.

Non-Final Office Action dated Aug. 23, 2017 in U.S. Appl. No. 14/565,582, 9 pages.

* cited by examiner

LAST SYSTEM FOR BRAIDING FOOTWEAR

BACKGROUND

The present embodiments relate generally to footwear and in particular to a method for making footwear and an associated system.

Lasts, such as footwear lasts, may be used to make footwear. A last may generally have the shape of a foot, including a forefoot portion, a midfoot portion and a heel portion. The last may help provide contouring for the assembled article and helps to create a desired fit.

SUMMARY

In one aspect, the present disclosure is directed to an article forming member for a braiding system. The article forming member includes a body portion, where the body portion is substantially similar in shape to a last for an article of footwear. The body portion includes a forefoot region. The article forming member also includes a flange portion, where the flange portion includes a first end and a second end. The flange portion is disposed adjacent to the forefoot region of the body portion. The article forming member further includes a cuff region, where the shape of the cuff region is substantially different from the shape of the flange portion.

In another aspect, the present disclosure is directed to a braiding system for the manufacture of a braided upper for an article of footwear including an article forming member, where the article forming member includes a body portion and a flange portion, and where the body portion comprises a cuff region. The shape of the cuff region is substantially different from the shape of the flange portion. The braiding system further includes a braiding apparatus, and the article forming member is configured to be inserted through the braiding apparatus to form the braided upper.

In another aspect, the present disclosure is directed to a method of manufacturing a braided structure. One step includes associating an article forming member with a braiding apparatus, where the article forming member includes a body portion with a forefoot region and a heel region. The article forming member also includes a flange portion with a first end and a second end, where the first end is attached to the body portion. The braiding apparatus includes a central braiding area. A next step includes associating the article forming member with the braiding apparatus so that a first axis of the flange portion intersects the central braiding area, and moving the flange portion through the central braiding area. The first axis extends from the first end of the flange portion to the second end of the flange portion. Another step includes rotating the article forming member so that a second axis of the body portion intersects the central braiding area, and then moving the forefoot region through the central braiding area. The second axis of the body portion extends from the forefoot region to the heel region. The method thereby forms a braided structure on the article forming member.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

The following discussion and accompanying figures disclose the use of an article forming member 100 for the manufacture of an article with a braided structure. One type of braided structure may be an upper for an article of footwear. In some cases, material can be applied around article forming member 100 to form an upper for an article of footwear. Concepts associated with the upper disclosed herein may be applied to a variety of athletic footwear types, including soccer shoes, baseball shoes, football shoes, and golf shoes, for example. Accordingly, the concepts disclosed herein apply to a wide variety of footwear types.

Throughout the detailed description and in the claims, the term "braided structure" is used to refer to the structure created by a plurality of strands that are braided together. In the case of article forming member 100, the component comprising a braided structure may be an upper for an article of footwear. The term "braided configuration" will be used to refer to the relative disposition of different components, including braided components, braid density, strands, laces and floating cables.

In different embodiments, methods of manufacturing an article using article forming member 100 can vary. In particular, the material can be shaped around article forming member 100. In some embodiments, braiding can be used to form three-dimensional structures. The braiding system discussed below could be used for forming any type of article including uppers comprising any type of material. A "braiding system" for purposes of this description refers to a system including an article forming member 100 and a braiding machine for the purpose of forming braided structures. In some embodiments, article forming member 100 may be used to conform the braided structure to the desired shape and size.

Figure 1:
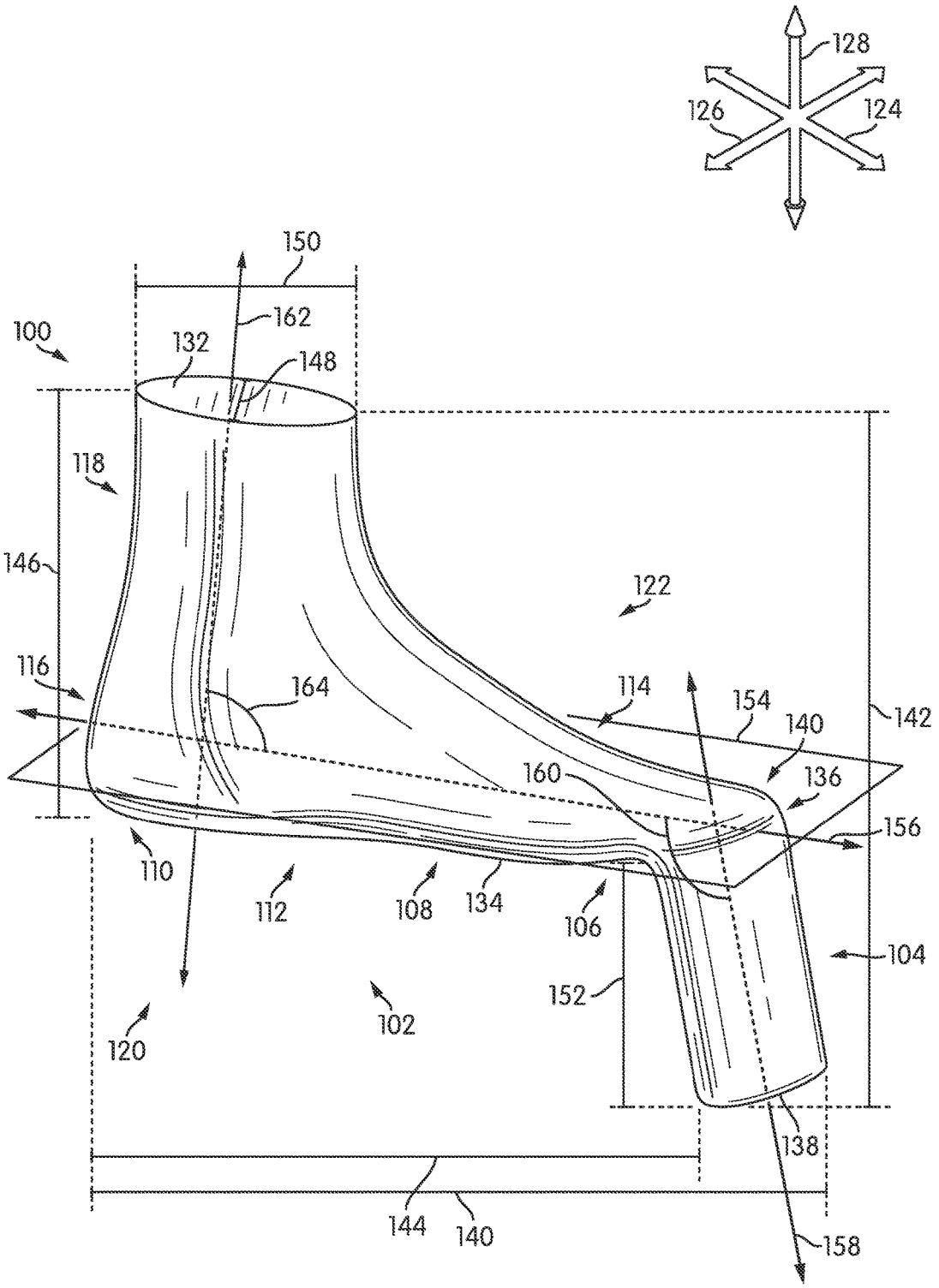
FIG. 1 is an isometric view of an embodiment of an article forming member.
Figure 2:
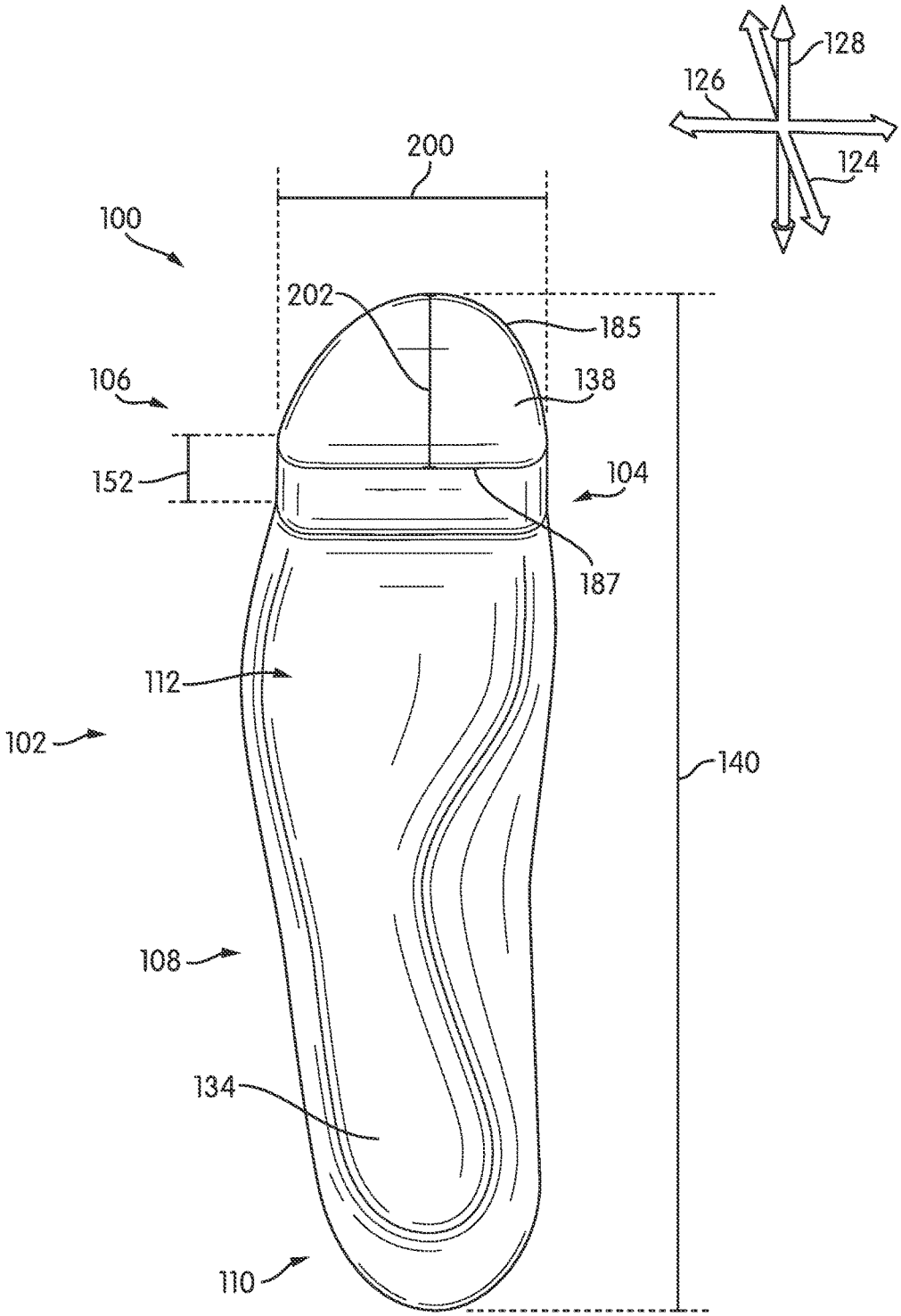
FIG. 2 is a bottom-up view of an embodiment of an article forming member.

FIGS. 1 and 2 illustrate isometric views of an embodiment of article forming member 100. Referring to FIG. 1, in some embodiments, article forming member 100 may include a body portion 102 and a flange portion 104. In other embodiments, article forming member 100 may include various other portions to provide different shapes or sizes to article forming member 100. In some embodiments, article forming member 100 can be used to facilitate the assembly of an article. In other embodiments, different foundational elements or solid forms may be used as article forming member 100 in the process of assembly. In some embodiments, this may include an article forming member 100 with a body portion 102 and no flange portion 104. In some cases, a foot shaped mechanical form, such as a last for an article of footwear, may be used. In other cases, various components associated with a last may be used.

In different embodiments, article forming member 100 may be used to form any type of article of footwear including, but not limited to: a running shoe, a high heel shoe, a boot, a slip-on shoe, a high top shoe, a low top shoe, as well as other types of footwear. Article forming member 100 could also be associated with the manufacturing of any type of footwear used for sporting activities including, but not limited to: a basketball shoe, a soccer shoe, a football shoe, a rugby shoe, a baseball shoe as well as other types of footwear.

In different embodiments, the structure of article forming member 100 could vary. In some embodiments, article forming member 100 may be a substantially monolithic portion. For example, article forming member 100 could comprise various portions that are integrally formed together. In other embodiments, article forming member 100 may comprise multiple distinct portions that are joined together or otherwise associated with one another.

In one embodiment, seen in FIGS. 1 and 2, article forming member 100 is monolithic, and includes a body portion 102 and a flange portion 104. The term body portion 102 as used throughout this detailed description and in the claims may generally refer to an object roughly formed in the shape of a portion of a human foot. In some embodiments, body portion 102 may resemble a last. In some cases, body portion 102 may have a shape configured for manufacturing articles having a general fit and/or style. In other cases, body portion 102 may be shaped for manufacturing an article of footwear with a predetermined fit and style.

Flange portion 104 may be a portion of article forming member 100 that is disposed adjacent to body portion 102. Body portion 102 and flange portion 104 may be a single piece or monolithic member comprising article forming member 100 in some embodiments. In other embodiments, body portion 102 and flange portion 104 may be distinct portions that are joined to produce article forming member 100. In some embodiments, article forming member 100 may not include either body portion 102 or flange portion 104.

For consistency and convenience, directional adjectives are employed throughout this detailed description corresponding to the illustrated embodiments. The term "longitudinal" as used throughout this detailed description and in the claims refers to a direction extending a length of article forming member 100. In some cases, for example, a longitudinal direction 124 may extend from forefoot region 106 to heel region 110 of body portion 102. Also, the term "lateral" as used throughout this detailed description and in the claims refers to a direction extending a width of article forming member 100. In one case, lateral direction 126 may extend between medial side 122 and lateral side 120 of article forming member 100. Furthermore, the term "vertical" or vertical direction 128 as used throughout this detailed description and in the claims refers to a direction generally perpendicular to both lateral direction 126 and longitudinal direction 124, or the direction perpendicular to the horizontal direction.

The term "forward" is used to refer to the general direction in which the toes of a foot point, and the term "rearward" is used to refer to the opposite direction, i.e., the direction in which the heel of the foot is facing. The term "horizontal" or as used throughout this detailed description and in the claims, refers to any direction substantially parallel with longitudinal direction 124 or lateral direction 126, and all directions in between. The term "vertical" refers to any direction substantially perpendicular to longitudinal direction 124 or lateral direction 126, and includes vertical direction 128.

The terms "top," "upper portion," "upper surface," and other similar terms refer to the portion of an object disposed furthest from bottom surface 134 of body portion 102 and/or second end 138 of flange portion 104. The terms "bottom," "bottom surface", "lower," and other similar terms refer to the portion of an object disposed closest to bottom surface 134 and/or second end 138.

Generally, in many cases, the term "upward" will refer to vertical direction 128 heading away from a ground surface, while the term "downward" refers to vertical direction 128 heading towards a ground surface. Similarly, the term "side," as used in this specification and in the claims, refers to any portion of a component facing generally in a lateral, medial, forward, and/or rearward direction, as opposed to an upward or downward direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

Body portion 102 and flange portion 104, as well as other components that may be associated with article forming member 100, may be divided into various regions that are representative of the various regions of a finished article of footwear. It will be understood that these regions are not intended to demarcate precise regions of article forming member 100, and in some cases, one or more of these regions may be overlapping. In the embodiment of FIGS. 1 and 2, article forming member 100 is divided into seven general regions: a forefoot region 106, a midfoot region 108, a vamp region 114, a heel region 110, a sole region 112, a cuff region 118, and an ankle region 116. Forefoot region 106 generally includes portions of footwear corresponding with the toes and the joints connecting the metatarsals with the phalanges. Midfoot region 108 generally includes portions of footwear or component corresponding with an arch area of a foot. Vamp region 114 generally includes portions covering the front and top of a foot, extending from the toes to the area where the foot joins the ankle. Heel region 110 generally corresponds with rear portions of the foot, including the calcaneus bone. Sole region 112 generally includes the area corresponding with the sole of a foot. Sole region 112 is typically associated with the ground-engaging surface of an article of footwear. Ankle region 116 generally includes portions of footwear or component corresponding with an ankle. Cuff region 118 may be associated with the area above ankle region 116, where the ankle joins the foot.

Components associated with footwear, such as article forming member 100, may also include a lateral side 120 and a medial side 122, which extend through each of forefoot region 106, midfoot region 108, and heel region 110 along body portion 102 as well as along flange portion 104. Lateral side 120 and medial side 122 correspond with opposite sides of a component associated with the foot. More particularly, lateral side 120 corresponds with the area of the foot that faces away from a corresponding foot, and medial side 122 corresponds with the area of the foot that faces toward the corresponding foot.

It should be noted that the terms forefoot region 106, midfoot region 108, vamp region 114, heel region 110, sole region 112, cuff region 118, ankle region 116, lateral side 120, and medial side 122 can be applied to various individual components associated with footwear, such as an upper, a sole structure, an article of footwear, an article forming member, and/or an upper. It will be understood that forefoot region 106, midfoot region 108, vamp region 114, heel region 110, sole region 112, cuff region 118, and ankle region 116, are only intended for purposes of description and are not intended to demarcate precise regions of the components. Likewise, lateral side 120, and medial side 122 are intended to represent generally two sides of a component, rather than precisely demarcating the component into two halves.

It should be understood that any components that may be discussed as related to article forming member 100 may be similarly related to a second, complementary article forming member. The term complementary, as used through this specification, refers to the association of a left article of footwear with a right article of footwear, and vice-versa. However, in discussing the system as applied to a pair of footwear it should be understood that each article forming member may also be configured independently. Depending on the customization selected, user preferences, and other factors, complementary article forming members may not necessarily include substantially similar article forming members or identical article forming member components.

In addition, for purposes of clarity in this detailed description and claims, article forming member 100 may include referential terms relating to the spatial orientation of article forming member 100. In FIG. 1, a first plane 154 is illustrated generally corresponding with bottom surface 134 of sole region 112. In other words, first plane 154 may be approximately parallel with, and/or approximately coincide with, bottom surface 134. Furthermore, a first axis 156 extending from heel region 110 to the toe area of forefoot region 106 is depicted. First axis 156 is parallel with first plane 154. Along flange portion 104 a second axis 158 extends from first end 136 of flange portion 104 to second end 138 of flange portion 104. In some cases, second axis 158 may be associated with a central axis of flange portion 104 that extends lengthwise through flange portion 104.

Second axis 158 forms a non-zero angle with first plane 154. In other words, second axis 158 may not be parallel with first plane 154. Moreover, second axis 158 is seen to form a first angle 160 with first axis 156. In different embodiments, first angle 160 may range between 0 degrees to 180 degrees. In one embodiment, first angle 160 may range between 60 degrees and 120 degrees. In another embodiment, first angle 160 may range between 60 degrees and 120 degrees. In one exemplary embodiment, first angle 160 may be an obtuse angle. For example, in the embodiment of FIG. 1, first angle 160 may be approximately 110 degrees.

In addition, in an exemplary embodiment, a third axis 162 extending from heel region 110 to top surface 132 of cuff region 118 is illustrated. Third axis 162 is forms a non-zero angle with first plane 154. In other words, third axis 162 may not be parallel with first plane 154. In one embodiment, third axis 162 forms a different angle with first plane 154 than the angle first axis 156 forms with first plane 154. Moreover, third axis 162 is seen to form a second angle 164 with first axis 156. In different embodiments, second angle 164 may range between 0 degrees to 180 degrees. In one embodiment, second angle 164 may range between 60 degrees and 120 degrees. In another embodiment, second angle 164 may range between 60 degrees and 120 degrees. In some embodiments, second angle 164 may be less than first angle 160. For example, in the embodiment of FIG. 1, second angle 164 may be approximately 85 degrees.

In different embodiments, the geometry of article forming member 100 and portions comprising article forming member 100 may vary. In some embodiments, some portions of article forming member 100 may correspond to a shoe last. Shoe lasts are forms, shaped like a foot, around which shoes may be shaped or assembled during their manufacture. In one embodiment, body portion 102 may generally resemble a shoe last. In the embodiments of FIGS. 1 and 2, article forming member 100 includes a top surface 132, which may be relatively flat and planar compared to other portions of article forming member 100. In other embodiments, top surface 132 may be curved, bent, or angled in some way. In some embodiments, top surface 132 may be generally smooth, while in other embodiments, top surface 132 may be rough and/or uneven. In some embodiments, top surface 132 of cuff region 118 is substantially flat and planar. In one embodiment, when article forming member 100 is viewed from above, top surface 132 may be a generally flat surface, where the perimeter of top surface 132 includes a curved edge. In the embodiment of FIG. 1, top surface 132 has a perimeter that has a generally elliptic shape. In other embodiments, top surface 132 may have any other regular or irregular shape.

Furthermore, in some embodiments, different portion of article forming member 100 may have a shape generally corresponding with a similar portion of a foot. For example, in some cases, forefoot region 106 may have a geometry approximately corresponding to the geometry of the forefoot of a foot. In some cases, midfoot region 108 may have a geometry approximately corresponding to the geometry of a midfoot of a foot. In some cases, heel region 110 may have a geometry approximately corresponding to the geometry of a heel of a foot.

From top surface 132, article forming member 100 may extend downward along cuff region 118 and ankle region 116. In FIGS. 1 and 2 cuff region 118 is a curved area. In some cases, cuff region 118 may be an approximately cylindrical area. In other embodiments, cuff region 118 may be more level or planar (e.g., cuff region 118 may include approximately planar or flat sides). In another embodiment, cuff region 118 may include any other circumference or shape. Cuff region 118 may be disposed above and adjacent to ankle region 116, which may vary in size from cuff region 118. In the embodiment of FIGS. 1 and 2, ankle region 116 is thicker and wider than cuff region 118. Ankle region 116 may also include various additional curves that may correspond to the ankle area of a human foot. Cuff region 118 may rise above ankle region 116, and represent the highest area extending upward from article forming member 100 in vertical direction 128.

Ankle region 116 may be disposed adjacent to vamp region 114. Vamp region 114 and ankle region 116 may share bottom surface 134 that extends along sole region 112. In some embodiments, bottom surface 134 may be generally flat relative to other portions of article forming member 100. Bottom surface 134 is parallel to the ground surface when article forming member 100 is oriented in an upright position. In FIGS. 1 and 2, vamp region 114 corresponds to the area of a human foot not directly joined to the ankle.

In some embodiments, vamp region 114 may extend and join flange portion 104. Flange portion 104 may comprise various geometries, shapes, and sizes in different embodiments. In one embodiment, flange portion 104 may include two ends. A first end 136 of flange portion 104 may be joined to vamp region 114. Second end 138 of flange portion 104 may be a free end disposed further from body portion 102 than first end 136. First end 136 and second end 138 may be generally the same size and shape, or they may each differ in size and/or shape.

In some embodiments, flange portion 104 may extend outward and downward from forefoot region 106, near an area associated with the toes. Flange portion 104 may represent the lowest area (in vertical direction 128) of article forming member 100. In FIG. 2, second end 138 of flange portion 104 is substantially flat and planar. In other embodiments, second end 138 may be rough and/or uneven. In one embodiment, when viewed from below, second end 138 may be a generally flat surface, where the perimeter of the surface includes a curved edge (which may be convex) joined to a substantially linear edge. In the embodiment of FIG. 2, second end 138 has a perimeter portion that includes a generally half-ellipse shape or curved edge 185, and a perimeter portion that includes a generally straight or linear shape or straight edge 187.

In different embodiments, second end 138 may be any shape or geometry, including irregular or regular shapes. In some embodiments, for example, a non-polygonal or polygonal shape may comprise second end 138. Second end 138 may be at least partially triangular, quadrilateral, pentagonal, hexagonal, heptagonal, octagonal, or another regular or irregular shape. In one embodiment, second end 138 may be an approximately semi-circular shape, a generally half oval shape, at least a partially elliptical shape, or another curved shape.

In different embodiments, article forming member 100 may comprise different sizes. In FIG. 1, article forming member 100 includes a first length 140, extending in longitudinal direction 124 from the end associated with heel region 110 in body portion 102 to the opposite end associated with flange portion 104. As seen in FIG. 1, first length 140 represents the maximum length of article forming member 100 in longitudinal direction 124. Article forming member 100 also includes a first height 142, extending in vertical direction 128. As seen in FIG. 1, first height 142 represents the full height of article forming member 100 from top surface 132 to second end 138.

Article forming member 100 further includes a second height 146, extending in vertical direction 128 from top surface 132 to bottom surface 134, and represents the full height of body portion 102. In some embodiments, second height 146 may be selected based on the cuff height desired for the article of footwear. In addition, article forming member 100 includes a second length 144, extending in longitudinal direction 124 from the most rearward end of article forming member 100 to the most forward end of vamp region 114. Second length 144 represents the full length of body portion 102. In different embodiments, second length 144 will correspond to the various range of articles of footwear that may be manufactured. For example, in some embodiments, second length 144 may range between 9 centimeters and 50 centimeters. In other embodiments, second length may range from 20 centimeters to 35 centimeters. As first length 140 includes flange portion 104, second length 144 will be less than first length 140. Thus, first length will typically have a greater size range. In different embodiments, first length 140 may be between 10 centimeters and 55 centimeters. In one embodiment, first length 140 may be approximately 1-6 centimeters greater than second length 144.

In different embodiments, top surface 132 and flange portion 104 may also include varying sizes. In FIG. 1, top surface 132 can be seen to include a third length 150, and a first width 148. Third length 150 corresponds to the maximum length of top surface 132 in longitudinal direction 124, and first width 148 corresponds to the maximum width of top surface 132 in lateral direction 126. In different embodiments, the size range of third length 150 and first width 148 may be generally similar to the corresponding area of a human foot. In some embodiments, third length 150 may be similar to the length of a human ankle, and first width 148 may be similar to the width of a human ankle.

Flange portion 104 includes a fourth length 152, a fifth length 202, and a second width 200. Fourth length 152 corresponds to the maximum length of flange portion 104 as it extends from first end 136 to second end 138 in longitudinal direction 124. In some embodiments, fourth length 152 may be similar to second height 146. In one embodiment, fourth length 152 may be greater than second height 146.

Fifth length 202 represents the full length of second end 138 in longitudinal direction 124, and second width 200 represents the maximum width of second end 138 in lateral direction 126. In some embodiments, first width 148 of cuff region 118 may be less than, or more narrow than, second width 200 of flange portion 104. In different embodiments, fifth length 202 and/or second width 200 may be adjusted depending on various factors, such as the method of manufacture, the type of braiding machine used, or other factors.

In different embodiments, various portions of article forming member 100 may differ substantially in size. Sizing of various portions of article forming member 100 may be configured for individual foot sizes, foot shapes, and/or requirements of the braiding machine. For example, the geometry of article forming member 100 may be adjusted to match various features of a foot that may vary from one individual to another. In some embodiments, article forming member 100 can include provisions for changing the geometry of article forming member 100 to match various protruding features of a foot of one or more individuals. For example, human structural characteristics such as bunions or heel spurs may cause a foot to protrude outwards at the toes or heel. In one embodiment, article forming member 100 can include provisions to change the geometry to include matching contours of a foot with bunions and/or heel spurs.

Thus, in some embodiments, as illustrated in the embodiments of FIGS. 1-10, article forming member 100 may be highly asymmetrical. In other embodiments, article forming member 100 may be symmetrical. In one embodiment, flange portion 104 and cuff region 118 may be substantially similar, such that article forming member 100 is generally symmetrically shaped. In other embodiments, the rearward portion and the forward portion of article forming member 100 may differ in shape and size from one another.

In different embodiments, the material composition of article forming member 100 could vary. Some examples of different materials that may be used include, but are not limited to: plastics (including polyurethane plastics and thermoplastic polyurethane plastics), foam materials, metallic materials, composite materials (such as carbon-fiber composite materials, glass-fiber composite materials and other composite materials), wood, metal, rubber, other rigid or semi-rigid materials, as well as any other materials known in the art for use in making article forming members, lasts, casts, molds, or similar structures. Some embodiments may comprise an article forming member that is substantially monolithic, so that all portions of the article forming member have a substantially similar material composition. In other embodiments, however, some portions of an article forming member could be made of different materials from other portions of the article forming member. As one possible example, some embodiments can use different materials for constructing a medial portion and a lateral portion of the article forming member. In another embodiment, flange portion 104 may be made of a different material from body portion 102.

Such a variation in materials could provide different material characteristics for the different portions and could be used, for example, to modify the rigidity characteristics of flange portion 104 relative to body portion 102 (or vice versa). The type of materials used for an article forming member may be selected according various factors including, but not limited to, desired weight, desired rigidity, desired durability, desired abrasion resistance, desired resiliency, desired grip, molding, resistance to deformation, resistance to heat, resistance to changes in pressure, or other manufacturing considerations as well as possibly other factors.

In one embodiment, the various features of article forming member 100 may be selected to achieve an article forming member with a relatively low overall weight. For example, at least some portions of article forming member 100 may be hollow or filled with material that is of less weight than the material comprising the outer surface of article forming member 100. In other embodiments, article forming member 100 may be made so that the weight of article forming member 100 is equally distributed across article forming member 100. In some embodiments, the weight distribution across article forming member 100 may be balanced and permit article forming member 100 to be more stable.

In some embodiments, such as the embodiment shown in the figures, body portion 102 and flange portion 104 may comprise an integrally formed member. In other embodiments, article forming member 100 may comprise one or more separated, or separable, portions. For example, in another embodiment, body portion 102 and/or flange portion 104 could be separate portions. In such cases, body portion 102 and/or flange portion 104 could be separately attached to portions of article forming member 100. In still other embodiments, any two portions of an article forming member could be separable from each other. The selection of integral portions or separable portions can be made according to factors including desired material, weight, size, manufacturing considerations as well as possibly other factors.

Braided structures may be fabricated manually, or may be manufactured using automated braiding machinery, such as the machinery disclosed in U.S. Pat. Nos. 7,252,028; 8,261,648; 5,361,674; 5,398,586; and 4,275,638, all of which are incorporated by reference in their entirety herein. In some embodiments, articles of apparel and/or footwear may use one or more braided structures or configurations. In some embodiments, an article of footwear may include one or more regions that comprise a braided structure. For example, an upper may include one or more layers of a braided material. In one exemplary embodiment, a substantial majority of an upper can comprise a braided construction.

By using braiding, uppers for articles of footwear may be engineered with specific features tailored to a particular athletic or recreational activity. Braided uppers can be very light while conforming closely and comfortably to the wearer's feet. In some embodiments, the fit of the upper may be adjusted to provide the specific degree of tension or tightness the wearer may prefer. Braided uppers are characterized by close containment over the wearer's foot.

Figure 3:
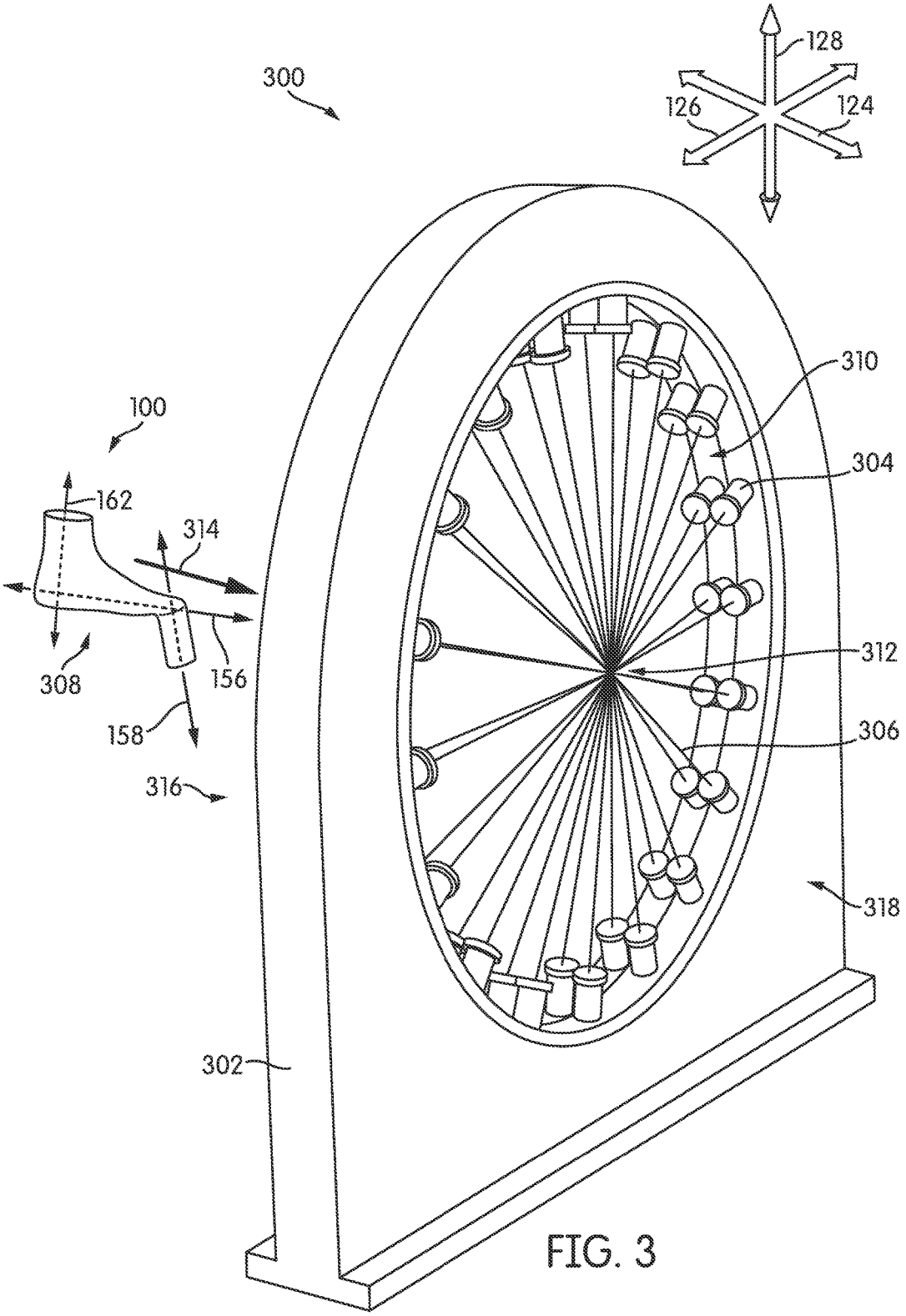
FIG. 3 is an embodiment of an article forming member and a braiding system.

Braiding can be used to form three-dimensional structures, as in the embodiments of a manufacturing sequence depicted in FIGS. 3-10, where a braiding system is used to braid an upper over article forming member 100. A "braiding system" for purposes of this description refers to a system including an article forming member 100 and a braiding apparatus 300 for the purpose of forming braided structures. In some embodiments, article forming member 100 may be used to conform the braided structure to a desired shape and size. Some embodiments may utilize an over braiding technique to manufacture some or all of a braided upper. For example, in some cases, an over braiding machine or apparatus may be used to form a braided upper. Specifically, in some cases, as seen in FIG. 3, article forming member 100 may be inserted from an entry side 316 through a central braiding area 312 of a braiding apparatus 300, thereby allowing one or more layers of a braided material to be formed over article forming member 100. Central braiding area 312 is the area disposed in the center of braiding apparatus 300 where braiding over article forming member 100 occurs. When braiding apparatus 300 is operating, and an object moves through braiding apparatus 300, strands may be wrapped or wound about the parts of the object that are disposed within central braiding area 312. After leaving central braiding area 312, article forming member 100 emerges from an exit side 318 of braiding apparatus 300.

Thus, during the braiding process, different portions and/or areas of article forming member 100 may be braided at different points in time while moving through central braiding area 312. A "presentation area" for purposes of this description and claims is the cross-sectional area of the portion of article forming member 100 that is directly exposed to central braiding area 312. In other words, the presentation area of a portion of article forming member 100 is the cross-sectional area of that portion in a plane defined by the central braiding area 312 (or a plane defined by braiding apparatus 300 more generally).

As article forming member 100 is inserted through central braiding area 312, strands may be braided onto a peripheral contoured portion of article forming member 100 that forms the perimeter, or periphery, of an associated presentation area. Thus, the peripheral contoured portion is the particular portion or region of the outer surface of article forming member 100 that will have strands make contact, or be wrapped, disposed, and/or attached around article forming member 100 as it moves through braiding apparatus 300.

In some embodiments, it may be desirable to provide a presentation area to a braiding apparatus with a relatively smooth peripheral contoured portion. As used herein, the term "smooth peripheral contoured portion" refers to a peripheral contoured portion that does not have any sections where the curvature changes to quickly. For example, a presentation area with a circular peripheral contoured portion would have constant curvature, which is smooth. In contrast, a presentation area with a rectangular contoured portion would include corners where the curvature changes abruptly. Providing a peripheral contoured portion that is generally rounded and/or smooth may improve performance. In some embodiments, utilization of a smooth peripheral contoured portion can improve performance as article forming member 100 moves through central braiding area 312. As yarns 306 intersect or approach one another in central braiding area 312, braiding apparatus 300 may perform more efficiently along a generally circular or otherwise more rounded cross-section. In contrast, peripheral contoured portions having an oblong shape with more edges for example, may require greater time and/or cost to braid. Similarly, peripheral contoured portions having shapes with relatively sharp edges may not move through central braiding area 312 as smoothly or as efficiently as peripheral contoured portions with softer and/or rounded contours. Thus, in some embodiments, the production output of braiding apparatus 300 may be improved when the geometry of a peripheral contoured portion is smoother and/or rounder, rather than portions comprising more oblong shapes.

In some embodiments, providing a smaller presentation area to braiding apparatus 300 as it moves through central braiding area 312 can also improve the efficiency of braiding apparatus 300 and the braiding system, as well as lower the costs of manufacture, by minimizing the waste of material. It can also decrease the expansion of central braiding area 312 that would be needed in order to permit the passage of article forming member 100 from entry side 316 to exit side 318. Thus, minimizing presentation area can also lower the strain on components of braiding apparatus 300.

Figure 4:
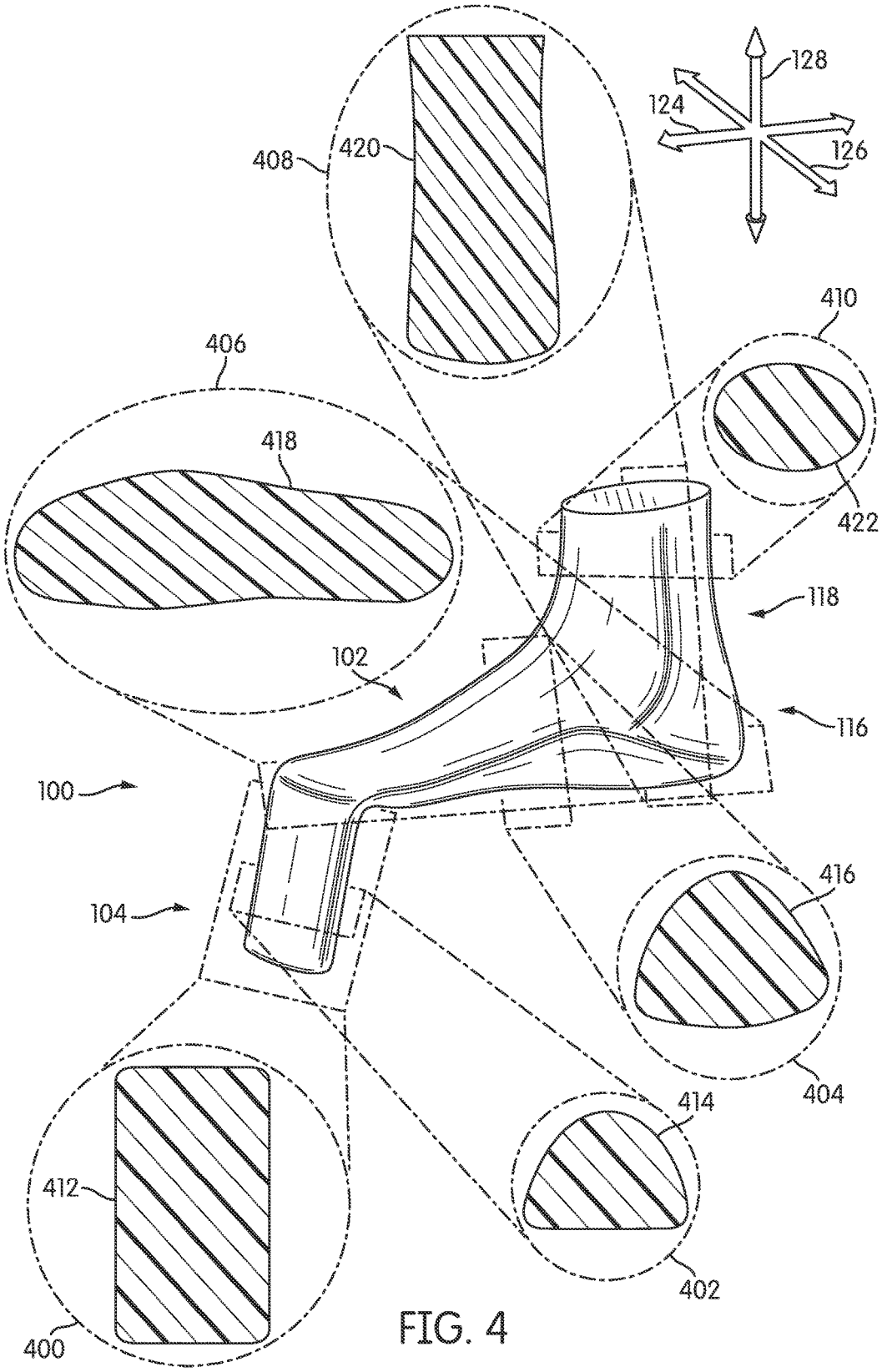
FIG. 4 is an isometric view of an embodiment of an article forming member.

As an example, referring to FIG. 4, an embodiment of article forming member 100 is shown with six portions of article forming member 100 depicted in cross-sectional views. These cross-sectional areas are intended to represent possible presentation areas, also referred to simply as areas, that may be presented at central braiding area 312 of braiding apparatus 300. A first area 400 in a generally vertical plane may be compared to a second area 402 along a generally horizontal plane. Both first area 400 and second area 402 correspond to cross-sectional areas of flange portion 104 of article forming member 100. However, second area 402 is substantially smaller than first area 400. In addition, a first peripheral contoured portion 412 of first area 400 is more oblong relative to a second peripheral contoured portion 414 of second area 402. Since second peripheral contoured portion 414 includes fewer corners and is more rounded (i.e., less oblong) than first peripheral contoured portion 412, it may be desirable to orient article forming member 100 so that second area 402 is presented to central braiding area 312 during the braiding process.

Similarly, a third area 404 in a generally vertical plane may be compared to a fourth area 406 along a generally horizontal plane. Both third area 404 and fourth area 406 correspond to cross-sectional areas of body portion 102 of article forming member 100. However, third area 404 is smaller than fourth area 406. In addition, the perimeter, or a third peripheral contoured portion 416 of third area 404, is rounder relative to a fourth peripheral contoured portion 418 of fourth area 406.

In addition, a fifth area 408 in a generally vertical plane may be compared to a sixth area 410 along a generally horizontal plane. Both fifth area 408 and sixth area 410 are cross-sectional areas corresponding to cuff region 118 of article forming member 100. However, fifth area 408 is larger than sixth area 410. Moreover, the perimeter associated with a fifth peripheral contoured portion 420 is more oblong relative to a sixth peripheral contoured portion 422 of sixth area 410. Thus, fifth peripheral contoured portion 420 can include less rounded corners or sharper edges along its border relative to sixth peripheral contoured portion 422.

In some embodiments, article forming member 100 may be rotated (or re-oriented) during the braiding process to help present relatively smooth, rounded and/or small presentation areas to central braiding area 312 of braiding apparatus 300. For example, in one embodiment, article forming member 100 may be rotated to present a rounded or circular peripheral contoured portion to braiding apparatus 300.

Furthermore, as described earlier, presentation areas introduced to central braiding area 312 with peripheral contoured portions that are more rounded, or less oblong, less irregular, or with fewer corners, can improve performance of braiding apparatus 300. As depicted in FIG. 4, the braid areas corresponding to second area 402, third area 404, and sixth braid area 410 are ideal for entry into central braiding area 312. This is in contrast to first area 400, fourth area 406, and fifth area 408, which may be less desirable presentation areas.

One embodiment of a manufacturing process for a braided structure is shown in FIGS. 3 and 5-10, which comprises article forming member 100 being associated with braiding apparatus 300. FIGS. 3 and 5-10 provide a schematic diagram illustrating an example of the use of article forming member 100 with a braiding apparatus 300 for the manufacture of a braided upper for an article of footwear. The details of this particular embodiment are discussed below.

Beginning with FIG. 3, article forming member 100 is shown disposed adjacent to braiding apparatus 300. Generally, braiding apparatus 300 may be any machine, system and/or device that is capable of applying one or more braided layers over article forming member 100 or any type of footwear last or other form, such as an over braiding machine. For purposes of clarity, braiding apparatus 300 is shown schematically in the figures. In some embodiments, braiding apparatus 300 may comprise an outer frame portion 302. In some embodiments, outer frame portion 302 may house one or more spools 304 of yarn 306. It should be noted that in other embodiments, braiding apparatus 300 may employ strands composed of material other than yarn 306, as discussed above.

In FIG. 3, article forming member 100 is oriented in a first position 308. In first position 308, body portion 102 of article forming member 100 is in the position an article of footwear would be when sitting in an upright position, with sole region 112 facing groundward. That is, body portion 102 is positioned as it would be when worn by a wearer standing on a substantially level surface. Additionally, flange portion 104, being joined to body portion 102 in the manner described with reference to FIGS. 1-2, is oriented so that second end 138 faces substantially groundward.

A plurality of yarn strands 310 extend from around the inner perimeter of outer frame portion 302. Each yarn 306 extends from spools 304 along outer frame portion 302 towards a central braiding area 312. As discussed below, a braided upper may be formed by moving article forming member 100 through central braiding area 312. In the embodiments of FIGS. 3 and 5-10, article forming member 100 is moved in a forward direction 314 toward braiding apparatus 300. In other embodiments, article forming member 100 may move along a different direction or move along multiple axes as it approaches braiding apparatus 300, and/or as it moves through braiding apparatus 300. Braiding apparatus may include entry side 316 and exit side 318. As seen in FIGS. 3 and 5-10, entry side 316 is the side of braiding apparatus 300 that article forming member 100 approaches as braiding begins. Exit side 318 is the side of braiding apparatus 300 that article forming member 100 will move and/or protrude outward from as it undergoes the braiding process.

As described above, in some embodiments, various orientations or positions of article forming member 100 may be utilized as article forming member 100 is moved through central braiding area 312. Different orientations of article forming member 100 may enhance the over braiding technique and provide greater efficiency in the production of the braided upper. FIGS. 3 and 5-10 illustrate the use of different orientations as article forming member 100 moves through central braiding area 312.

For purposes of convenience, the orientation of an article forming member relative to a braiding apparatus may be characterized according to the orientation of one or more axes of the article forming member. As used herein, an axis (e.g., a longitudinal axis) of a component is determined to be approximately perpendicular to, or approximately normal to, a surface, region or area, if an angle between the axis and the surface, region or area has a value in the range between approximately 45 degrees and 135 degrees. In some cases, an axis may be approximately perpendicular to a surface, region or area if the angle has a value in the range between approximately 75 degrees and 105 degrees.

Figure 5:
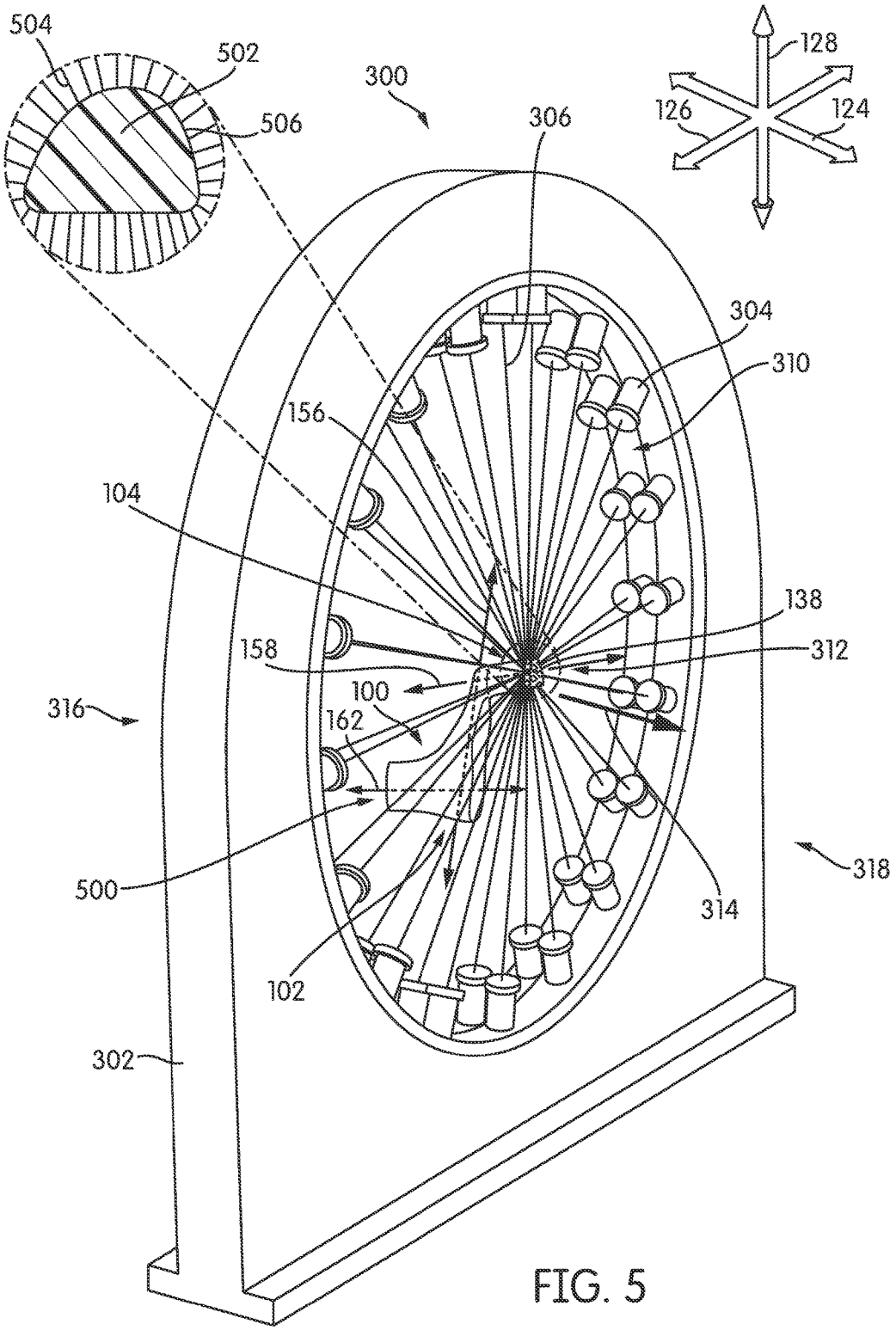
FIG. 5 is an embodiment of an article forming member and a braiding system.

In some embodiments, as depicted in FIG. 5, as article forming member 100 approaches entry side 316 of braiding apparatus 300, article forming member 100 may be disposed in a second position 500. In second position 500, article forming member 100 is turned approximately 180 degrees upward from a first position 308, so that forefoot region 106 is upward of heel region 110 in vertical direction 128. In addition, flange portion 104 is positioned so that as article forming member 100 moves in forward direction 314, second end 138 is presented initially to braiding apparatus 300. In some cases, first axis 156 in second position 500 extends in a generally vertical direction 128, while second axis 158 now extends in a generally horizontal direction. In other words, second axis 158 has become approximately perpendicular to central braiding area 312. In different embodiments, providing this type of presentation area of flange portion 104 can ensure the most rounded possible braid areas engaging with braiding apparatus 300, as discussed above with respect to second area 402.

Figure 6:
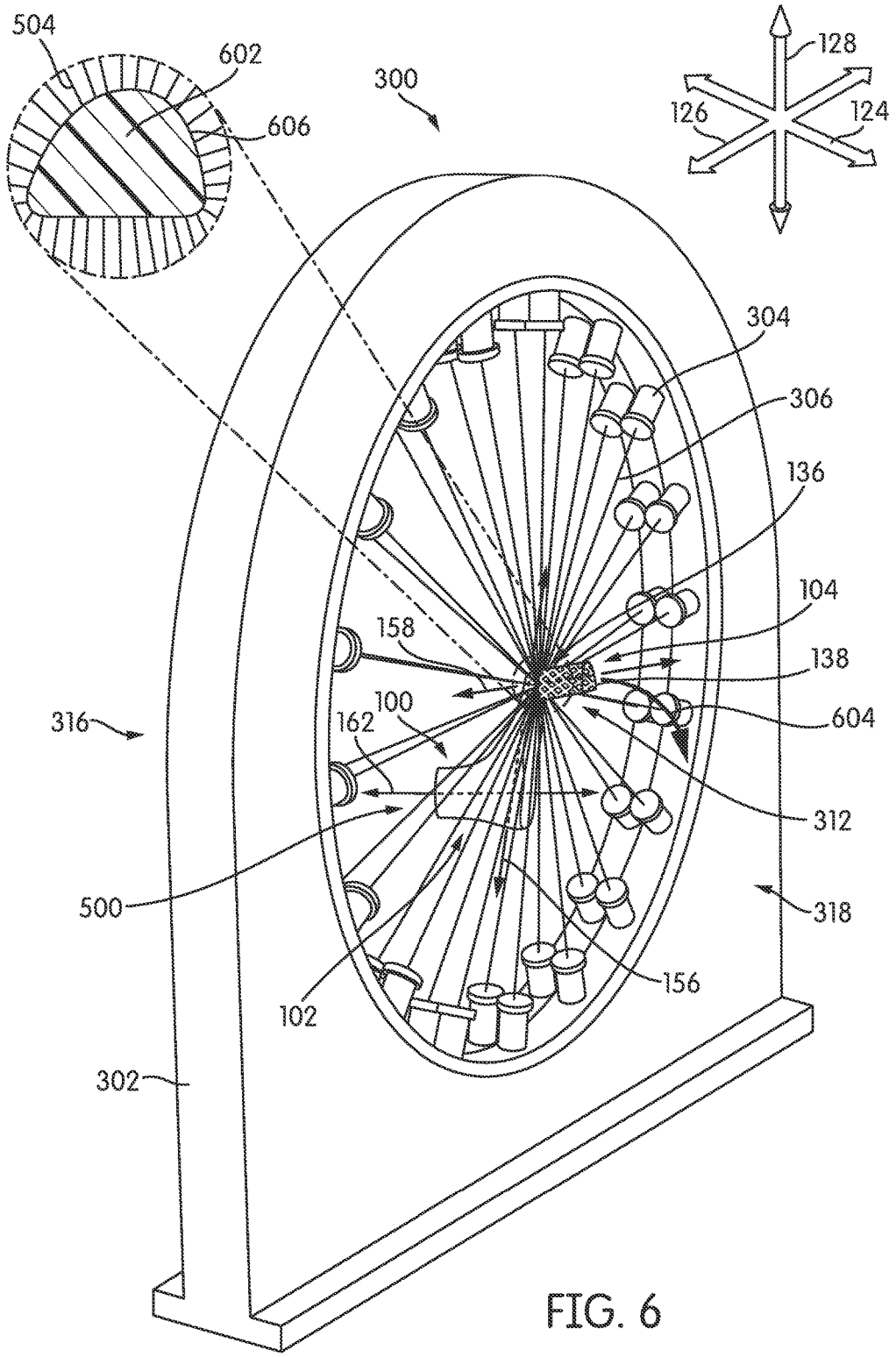
FIG. 6 is an embodiment of an article forming member and a braiding system.

In the step of FIG. 5, second end 138 of article forming member 100 has reached braiding apparatus 300 and has made contact with central braiding area 312. At this point, yarn 306 may be applied at second end 138 of flange portion 104. As seen in FIGS. 5 and 6, as article forming member 100 moves in forward direction 314, flange portion 104 moves through central braiding area 312 from second end 138 to first end 136. Second position 500 provides a seventh area 502 of flange portion 104 to braiding apparatus 300, which is similar to second area 402 as discussed with reference to FIG. 4 above. Seventh area 502 is illustrated in an enlarged view in FIG. 5, representing the presentation area, or cross-sectional surface area associated with or near second end 138. Strands 504 are shown as they wrap and/or are disposed around a peripheral contoured portion 506 of seventh area 502. By orienting article forming member 100 in second position 500, flange portion 104 is inserted through central braiding area 312 with a smaller and more rounded cross-sectional area than would be presented if article forming member 100 were pushed through with flange portion 104 in a different orientation (e.g., a vertical orientation).

A next step of an embodiment of the braiding process is shown in FIG. 6. Article forming member 100 has moved through braiding apparatus 300 so that first end 136 of flange portion 104 is emerging through exit side 318. An eighth area 602 associated with first end 136 can be seen in an enlarged illustration in FIG. 6. Strands 504 are shown as they wrap and/or are disposed around a peripheral contoured portion 606 of eighth area 602. In this case, eighth area 602 may be similar to seventh area 502. In other words, in some embodiments, the presentation area of flange portion 104 may not vary significantly from first end 136 to second end 138.

In FIG. 6, forefoot region 106 of an upper is beginning to be formed. In some embodiments, the density of the braiding can be varied by, for example, feeding forefoot region 106 of article forming member 100 through braiding apparatus 300 more slowly while forefoot region 106 is being formed (to produce a relatively higher density braid) than while midfoot region 108 is being formed (to produce a relatively lower density braid). Article forming member 100 may also be fed at an angle and/or twisted to form braided regions of varying patterns and/or configurations.

Figure 7:
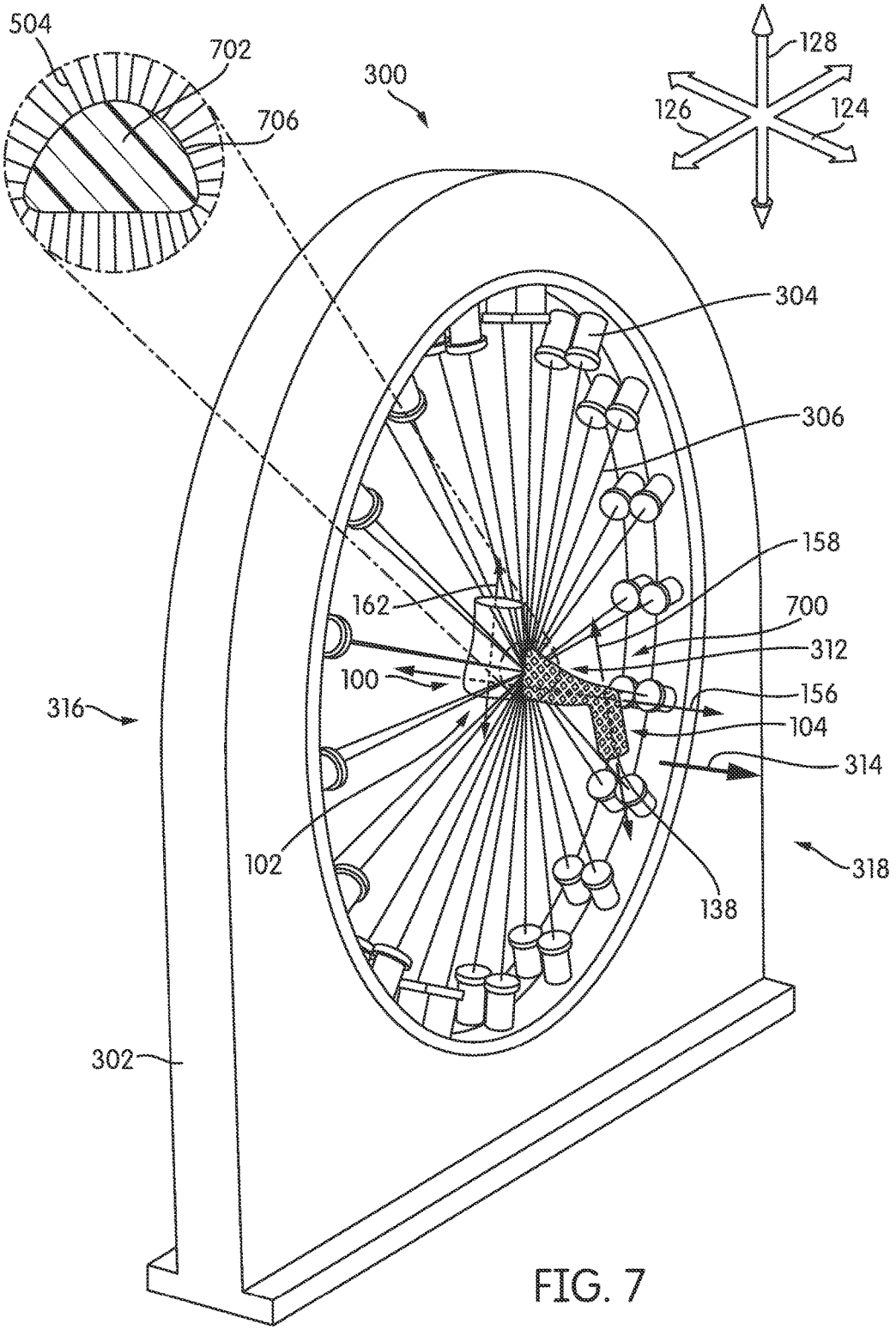
FIG. 7 is an embodiment of an article forming member and a braiding system.

As shown in FIGS. 6 and 7, the orientation of article forming member 100 can be altered during the braiding process. In some cases, the orientation of article forming member 100 can be altered through a rotation that occurs relative to specific areas along article forming member 100. For example, in one case, the orientation of article forming member 100 may be altered around a specific pivot area. In other cases, the orientation of article forming member 100 may be changed relative to other points or areas. In one case, article forming member 100 can rotate in a generally clockwise direction 604. The new orientation may be referred to as a third position 700, depicted in FIG. 7. In third position 700, first axis 156 extends in an approximately horizontal direction, while second axis 158 now extends in an approximately vertical direction 128. In other words, second axis 158 has become generally perpendicular to central braiding area 312.

By orienting article forming member 100 in third position 700, body portion 102 is inserted through central braiding area 312 with a smaller and more rounded cross-sectional area than would be presented if article forming member 100 were pushed through with body portion 102 in a different orientation (e.g., a vertical orientation). As described above with respect to FIG. 4, providing this type of peripheral contoured portion along body portion 102 can improve efficiency of braiding apparatus 300.

As article forming member 100 is in third position 700 and moves through central braiding area 312, the peripheral contoured portions associated with forefoot region 106 and midfoot region 108 along body portion 102 can be braided. In FIG. 7, vamp region 114 and the corresponding areas of sole region 112 of an upper have been formed, and braiding apparatus 300 is beginning to braid ankle region 116 of the upper. Thus, as seen in FIG. 7, as article forming member 100 moves in forward direction 314, vamp region 114 along with the corresponding parts of sole region 112 move through central braiding area 312, from forefoot region 106 to midfoot region 108.

In one embodiment, third position 700 provides a ninth area 702 of body portion 102 to braiding apparatus 300, which is similar to third area 404, discussed with reference to FIG. 4 above. Ninth area 702 is illustrated in an enlarged view in FIG. 7. As article forming member 100 moves in forward direction 314, peripheral contoured portion 706 of ninth area 702 is braided by strands 504. Thus, third position 700 can allow article forming member 100 to be oriented whereby a relatively smaller and/or rounder presentation area along body portion 102 is braided by braiding apparatus 300.

Figure 8:
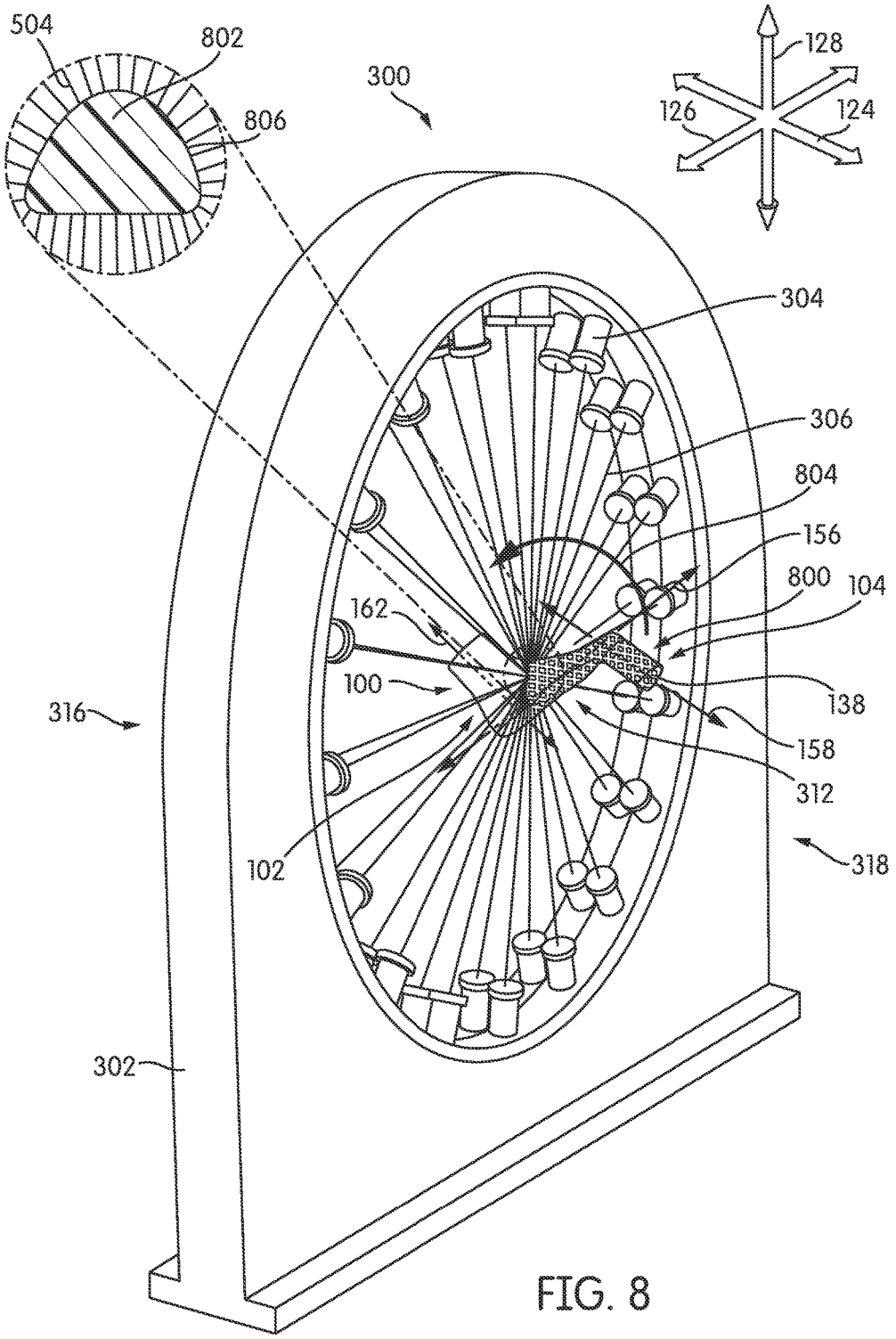
FIG. 8 is an embodiment of an article forming member and a braiding system.
Figure 9:
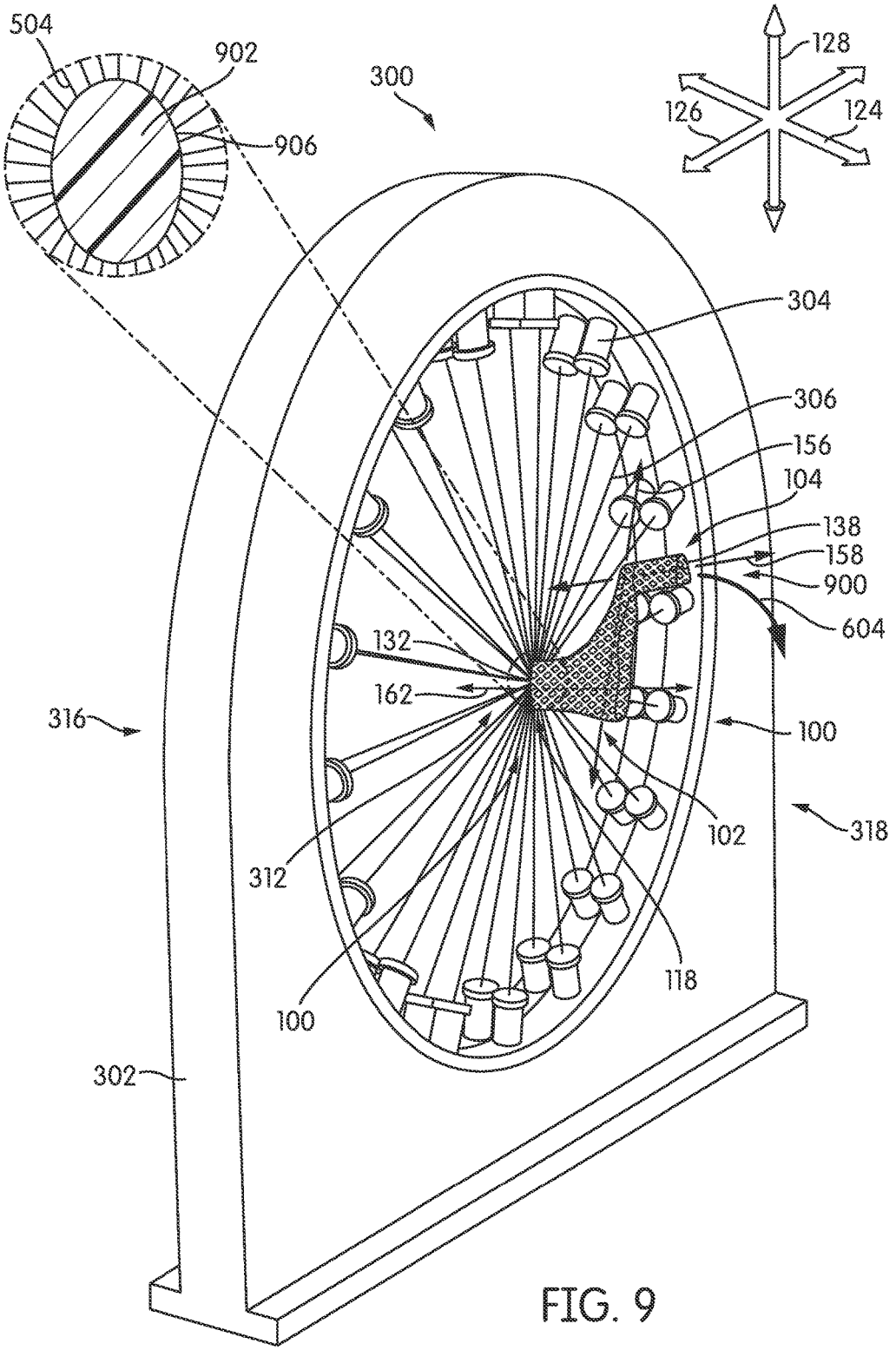
FIG. 9 is an embodiment of an article forming member and a braiding system.

A next step of an embodiment of the braiding process is shown in FIGS. 8-9. Article forming member 100 may alter orientation around another pivot area. The rotation may be in a counterclockwise direction 804, as seen in FIG. 8. As article forming member 100 rotates, it may be disposed for a period of time in a fourth position 800, as shown in FIG. 8. Both first axis 156 and second axis 158 in fourth position 800 extend in a generally diagonal direction relative to horizontal and vertical directions, and are also shown at a non-perpendicular angle with respect to central braiding area 312.

Strands 504 are shown as they wrap and/or are disposed around a peripheral contoured portion 806 of tenth area 802. Braiding continues during the rotational movement, as shown in the enlarged view of tenth area 802. Furthermore, in some embodiments, article forming member 100 may continue translational motion during a rotation. Thus, in some embodiments, article forming member 100 may move in forward direction 314 while being rotated.

After the counterclockwise rotation, article forming member 100 may be disposed in a fifth position 900, depicted in FIG. 9. In fifth position 900, first axis 156 and third axis 162 extend in a generally vertical direction 128, and second axis 158 extends in a generally horizontal direction. In other words, third axis 162 has become approximately perpendicular to central braiding area 312. By orienting article forming member 100 in fifth position 900, cuff region 118 of body portion 102 is inserted through central braiding area 312 with a smaller and more rounded cross-sectional area than would be presented if article forming member 100 were pushed through with cuff region 118 in a different orientation (e.g., a vertical orientation). Thus, providing this type of presentation area of cuff region 118 of body portion 102 can provide relatively more rounded peripheral contoured portions contacting braiding apparatus 300, as discussed above with respect to sixth area 410 in FIG. 4.

As article forming member 100 is in fifth position 900 and moves in forward direction 314 through central braiding area 312, the surface areas associated with heel region 110, ankle region 116, and cuff region 118 along body portion 102 can be braided. In one embodiment, fifth position 900 provides an eleventh area 902 of body portion 102 to braiding apparatus 300, which is similar to sixth area 410 as discussed with reference to FIG. 4. Eleventh area 902 is illustrated in an enlarged view in FIG. 9, representing the surface area associated with or near top surface 132 of cuff portion 118. As article forming member 100 moves in forward direction 314, peripheral contoured portion 906 of eleventh area 902 is braided by strands 504.

Figure 10:
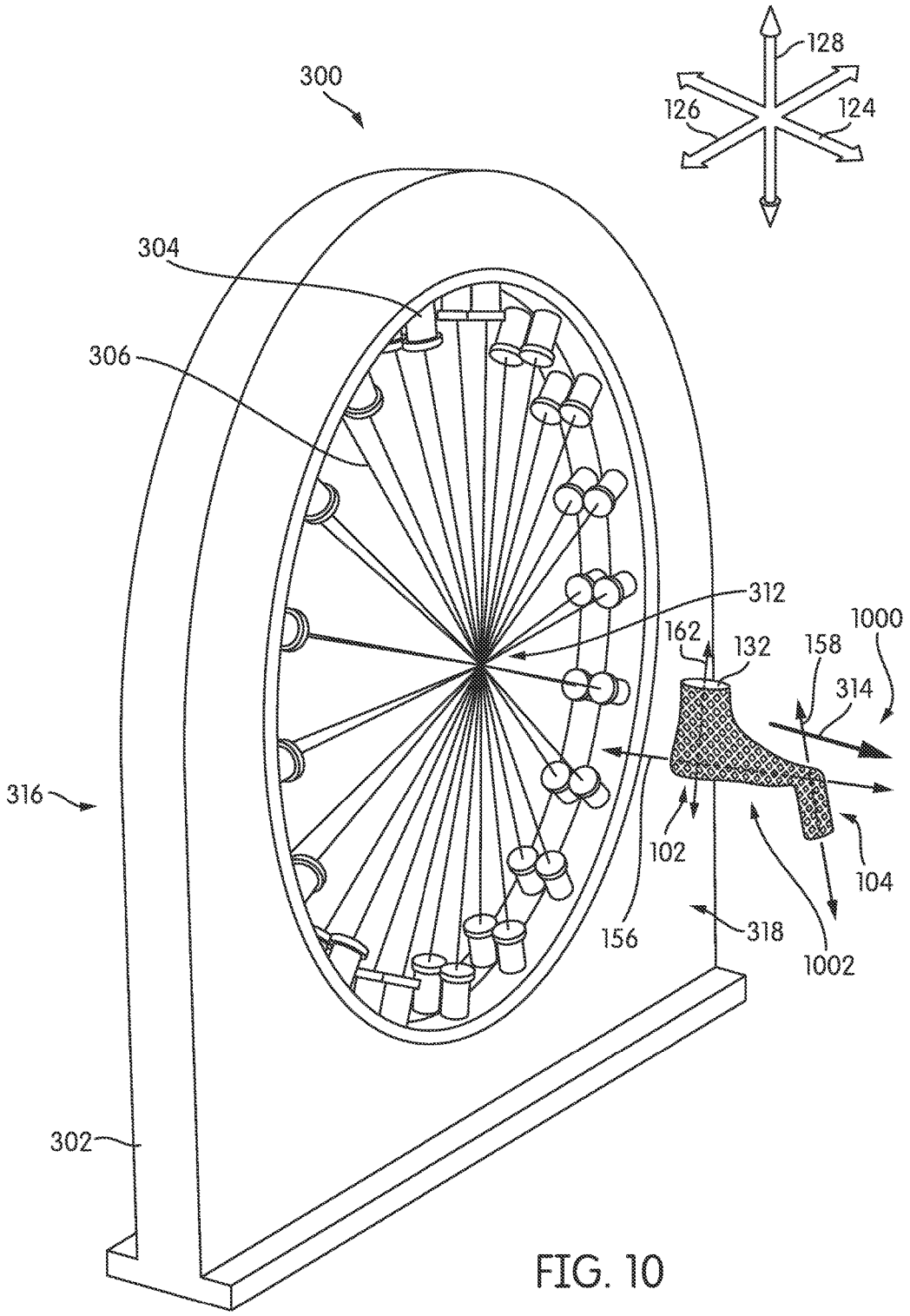
FIG. 10 is an embodiment of an article forming member and a braiding system.

After contact of top surface 132 with central braiding area 312, article forming member 100 may be oriented into a new position in a next step. In different embodiments, near the completion, upon completion, or after the completion of the braiding of article forming member 100, article forming member 100 may be rotated along another pivoting area in clockwise direction 604 as seen in FIG. 9, and moved into a sixth position 1000, as shown in FIG. 10. In sixth position 1000, first axis 156 extends in an approximately horizontal direction, while second axis 158 extends in an approximately vertical direction 128. In other words, first axis 156 has become generally perpendicular to central braiding area 312.

FIG. 10 shows a schematic illustration of a braided upper 1002 after being manufactured in braiding apparatus 300. In some embodiments, after the braiding process, article forming member 100 may be completely surrounded with braided material. In another embodiment, article forming member 100 may be partially surrounded by braided material. In other embodiments, article forming member 100 may also be fed through braiding apparatus 300 two or more times in order to form more complex structures (e.g., layered structures), or may alternatively be fed through two or more braiding apparatuses. In other embodiments, once the braiding process has been completed, braided upper 1002 may be removed from article forming member 100. In some cases, one or more openings (such as a throat opening) can be cut out of the resulting over braided upper 1002 to form the final upper for use in an article of footwear.

In different embodiments, the braiding process may include additional steps. In one embodiment, there may be a further step of cutting or separating the braid from article forming member 100. In another embodiment, there may be a step where article forming member 100 is fully removed from the braided structure. In some embodiments, the braided structure may be associated with other components including but not limited to a sole or trim, to form a final article. In other embodiments, the braiding process may include any process or components disclosed in Bruce et al., application Ser. No. 14/495,252, filed Sep. 24, 2014, titled "Article of Footwear With Braided Upper", the entirety of which is hereby incorporated by reference.

As mentioned earlier, in some embodiments, the use of an asymmetrical article forming member 100 may promote additional benefits to the braiding system. In one embodiment, as body portion 102 may provide a function similar to that of a last for an article of footwear, flange portion 104 may serve a different function in the assembly process. For example, various conveyer types may be utilized in the braiding system. Flange portion 104 may allow improved linkage to the various conveyers, in a way that does not interfere or interrupt the braided structure from forming and maintaining a smooth and unbroken braided pattern along body portion 102.

The process described herein can include provisions for mounting, rotating, and/or moving article forming member 100 through braiding apparatus 300. In some cases, article forming member 100 may be provided with a hole for receiving a post. In other cases, article forming member 100 may include a threaded post for mounting. With this arrangement, article forming member 100 can be screwed onto a stand or other support for forming an article around article forming member 100.

In some embodiments, article forming member 100 may be associated with a moving conveyer for translational motion through braiding apparatus 300. In one case, article forming member 100 may be pushed through braiding apparatus 300 manually, by a linking mechanism, a linkage conveyer system, or by another apparatus. In some embodiments, article forming member 100 may be rotated through braiding apparatus 300 manually and/or through various automated processes.

In different embodiments, different components or articles may comprise one or more layers of braided materials. In different embodiments, these strands can be braided to form three-dimensional structures for a wide variety of applications. By changing the geometry, size, and/or other characteristics of article forming member 100, different braided structures may be formed. Generally, these principles could be applied to the manufacture of any article that may be worn or used by consumers. Examples of articles that are configured to be worn include, but are not limited to: footwear, gloves, shirts, pants, socks, hats, bags, undergarments, hairbands, as well as other articles.

In particular, in some embodiments, the upper of an article of footwear may comprise a plurality of strands that are braided together into a single braided construction having the overall geometry of a shoe last or foot. In different embodiments, the braided construction formed by plurality of strands may not be uniform, so that the braided configuration and/or the materials of the braided strands could vary over different regions of the upper. The structure of the plurality of strands may include structural properties such as the number of strands in the braid, the diameter of the strands, the density of the strands, and the material properties of the strands such as elasticity, rigidity, tensile strength, stretch, compressibility as well as possibly other material properties.

The configuration of a braided upper could vary over different regions of the structure. By incorporating regions with different braided configurations into an upper, the different regions can be configured with a variety of different properties, to improve the performance of the article of footwear and increase the comfort to the wearer. The configuration of a braided upper can be engineered by using different densities of braids in different parts of the upper, by using different braid patterns, by using floating cables to produce additional tension in specific regions, or by using different braiding materials in different regions of the upper. For example, different portions of an upper could have different braid densities and/or could be comprised of strands having different stretch or compressibility characteristics. Varying the stretch and/or compressibility characteristics of one or more portions of an upper may help to control comfort and feel at different locations. For example, increased stretch or compressibility in some locations may reduce sag and change the feel of the upper. In some cases, using highly stretchable and compressible strands in at least some portions of an upper may give those portions a sock-like feel.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article forming member for a braiding system, comprising:

a body portion, the body portion having the approximate shape of a foot, the body portion further including a cuff region, a heel region, a midfoot region and a forefoot region;

a flange portion extending at a first angle from the body portion, wherein the first angle is between 60 degrees and 120 degrees, and further wherein the flange portion includes a first end and a second end;

wherein the first end of the flange portion is attached to the forefoot region; and wherein the shape of the cuff region is substantially different from the shape of the flange portion.

2. The article forming member of claim 1, wherein the surface of the second end is generally flat, and wherein the perimeter of the second end includes a substantially linear edge and a curved edge.

3. The article forming member of claim 2, wherein the curved edge of the second end is similar in shape to a half-ellipse.

4. The article forming member of claim 2, wherein the cuff region includes a top surface, wherein the top surface is substantially flat, and wherein the top surface has a generally oval shape.

5. The article forming member of claim 1, wherein the body portion and the flange portion comprise a monolithic portion.

6. The article forming member of claim 3, wherein the article forming member is configured to be inserted through a braiding apparatus of the braiding system.

7. The article forming member of claim 1, further including a first length extending from the heel region to the forefoot region and a second length extending from the heel region to the second end of the flange portion, wherein the second length is greater than the first length.

8. The article forming member of claim 1, further including a first axis extending from the heel region to the forefoot region, a second axis extending from the first end of the flange portion to the second end of the flange portion, and a third axis extending from the heel region to the cuff region, wherein the first axis and the second axis form the first angle, wherein the second axis and the third axis form a second angle, and wherein the first angle is different than the second angle.

9. A braiding system for the manufacture of a braided upper for an article of footwear comprising:

an article forming member, wherein the article forming member includes a body portion and a flange portion, wherein the body portion comprises a cuff region, wherein the shape of the cuff region is substantially different from the shape of the flange portion and further wherein the flange portion extends at an angle between 60 degrees and 120 degrees from the body portion;

a braiding apparatus; and wherein the article forming member is configured to be inserted through the braiding apparatus to form the braided upper.

10. The braiding system of claim 9, wherein the braiding apparatus includes a central braiding area, wherein the article forming member is configured to move through the central braiding area, such that the flange portion moves through the central braiding area prior to the body portion.

11. The braiding system of claim 10, wherein the braiding apparatus is configured to form a braided structure on the article forming member as the article forming member is passed through the braiding apparatus.

12. The braiding system of claim 11, wherein the article forming member is configured to be rotated from a first position to a second position during the formation of the braided upper, wherein the first position is different than the second position.

13. A method of manufacturing a braided structure comprising:

associating an article forming member with a braiding apparatus, wherein the article forming member includes a body portion and a flange portion extending at an angle from the body portion, wherein the body portion further includes a forefoot region and a heel region, wherein the flange portion further includes a first end and a second end, the first end being attached to the body portion;

wherein the braiding apparatus includes a central braiding area;

associating the article forming member with the braiding apparatus so that a first axis of the flange portion intersects the central braiding area and moving the flange portion through the central braiding area, wherein the first axis extends from the first end of the flange portion to the second end of the flange portion;

rotating the article forming member so that a second axis of the body portion intersects the central braiding area and moving the forefoot region through the central braiding area, wherein the second axis extends from the forefoot region to the heel region;

thereby forming a braided structure on the article forming member.

14. The method of claim 13, wherein associating the article forming member with the braiding apparatus so that a first axis of the flange portion intersects the central braiding area includes orienting the flange portion such that the first axis is approximately perpendicular to the central braiding area.

15. The method of claim 14, where rotating the article forming member so that the second axis of the body portion intersects the central braiding area includes rotating the article forming member so that the second axis is approximately perpendicular to the central braiding area.

16. The method of claim 15, wherein the article forming member further includes a cuff region, wherein a third axis of the article forming member extends from the heel region to the cuff region, and wherein the method further includes rotating the article forming member so that the third axis is approximately perpendicular to the central braiding area.

17. The method of claim 13, further comprising moving the article forming member in a direction toward the braiding apparatus, moving the article forming member through the central braiding area, and moving the article forming member away from the braiding apparatus.

18. The method of claim 13, wherein the braided structure is an upper for an article of footwear.

19. The method of claim 13, wherein the body portion includes a cuff region, the cuff region includes a top surface, and the top surface is substantially planar, wherein the flange portion includes a second end, wherein the second end is substantially planar, and wherein the top surface and the second end are substantially different in shape.

* * * * *